US008079404B2

(12) United States Patent
Barbe et al.

(10) Patent No.: US 8,079,404 B2
(45) Date of Patent: Dec. 20, 2011

(54) LATERAL SEAL OF A CASTING GAP FORMED BETWEEN TWO CASTING ROLLERS OF A STRIP CASTING MACHINE

(75) Inventors: Jacques Barbe, Le Bourg (FR); Heinrich Marti, Forch (CH); Benno Steiner, Nebikon (CH)

(73) Assignee: Main Management Inspiration AG, Hergiswil (CH)

( * ) Notice: Subject to any disclaimer, the term of this patent is extended or adjusted under 35 U.S.C. 154(b) by 1067 days.

(21) Appl. No.: 11/662,617

(22) PCT Filed: Sep. 15, 2005

(86) PCT No.: PCT/EP2005/009942

§ 371 (c)(1),
(2), (4) Date: Nov. 6, 2007

(87) PCT Pub. No.: WO2006/029871

PCT Pub. Date: Mar. 23, 2006

(65) Prior Publication Data

US 2011/0132567 A1 Jun. 9, 2011

(30) Foreign Application Priority Data

Sep. 17, 2004 (CH) ..... 1535/04

(51) Int. Cl.
*B22D 11/06* (2006.01)

(52) U.S. Cl. ..... 164/428; 164/415

(58) Field of Classification Search ..... 164/415, 164/428, 480

See application file for complete search history.

(56) References Cited

U.S. PATENT DOCUMENTS 5,172,750 A * 12/1992 Birat et al. ..... 164/428
6,082,437 A * 7/2000 Damasse et al. ..... 164/428
6,378,598 B1 * 4/2002 Tonelli et al. ..... 164/428

FOREIGN PATENT DOCUMENTS

WO WO 2004/033130 A1 * 4/2004

* cited by examiner

*Primary Examiner* — Kevin P Kerns
(74) *Attorney, Agent, or Firm* — Brian Roffe

(57) ABSTRACT

Lateral seal of a casting gap formed between two casting rollers of a strip casting machine that can be placed against the casting rollers on the front face. The lateral seal includes a first moist part and a second part that is assigned to the front faces of the casting rollers. The second part forms a type of snout shape encompassing two legs which extend along the front faces of the casting rollers, join each other at the bottom, above a kissing point, so as to form a common area, and between which the first part protrudes from above. An insulating layer which separates the two parts from each other is inserted between the first and second part.

20 Claims, 8 Drawing Sheets

LATERAL SEAL OF A CASTING GAP FORMED BETWEEN TWO CASTING ROLLERS OF A STRIP CASTING MACHINE

FIELD OF THE INVENTION

The invention relates to a lateral seal of a casting gap formed between two casting rollers of a strip casting machine which is positioned on a front of the casting rollers and which comprises a first, wetted part and a second part allocated to front sides of the casting rollers whereby the second part has a "snout shape" with two legs which extend along front faces of the casting rollers and join together at the bottom above a kissing point to form a common area between which legs, the first part protrudes from above.

BACKGROUND OF THE INVENTION

A lateral seal of this type is disclosed in WO 2004/033130, FIGS. 7 to 9. It comprises a wetted first part made from a fireproof material and a second part made from a high-temperature-resistant material that is allocated to the front sides of the casting rollers. The second part has a kind of "snout shape" with two legs which extend along the casting roller front sides and join together at the bottom above a so-called kissing point to form a common area, between which legs the first part protrudes from above. The first part is made from a fireproof material, the second from a high-temperature-resistant alloy, a grey cast iron or a high-strength steel. The two parts are provided with a coating.

OBJECTS AND SUMMARY OF THE INVENTION

The underlying objective of the present invention is to improve a lateral seal of the aforementioned type not only with respect to its wearing resistant and durability but also with respect to heat loss in order to prevent unwanted hardening in this area.

This objective is achieved according to the invention by means of a lateral seal of a casting gap formed between two casting rollers of a strip casting machine, which is positioned on a front of the casting rollers, and which comprises a first, wetted part and a second part allocated to front sides of the casting rollers, whereby the second part has a "snout shape" with two legs which extend along front faces of the casting rollers and join together at the bottom above a kissing point to form a common area, between which legs the first part protrudes from above, and wherein between the first and second parts, an insulating layer is inserted which separates the two parts from one another.

In a further preferred embodiment of the lateral seal according to the invention the second part made from a preferably high-temperature-resistant metal is provided with a number of outlet openings for inert gas or lubricants such as oil, grease or graphite-containing coatings connected to a gas or lubricant source, aligned against the front sides of the casting rollers and distributed along the edges of the casting rollers. In another embodiment, the first wetted part is made at least partly from a high-temperature-resistant metal and is provided with a number of outlet openings for inert gas or lubricants such as oil, grease or graphite-containing coatings distributed over its entire surface, aligned against the sealing side and connected to an additional gas or lubricant source. In yet another embodiment, the first wetted part is designed as a metal plate comprising a number of openings distributed over its entire surface, wherein the openings are filled with a fireproof material and the outlet openings for inert gas or lubricants such as oil, grease or graphite-containing coatings are provided between the openings filled with fireproof material. In still another embodiment, the metal plate is provided with centrally protruding nose projecting between the casting rollers, the depth of which decreases from top to bottom. The first wetted part may be composed of a metal plate comprising a number of openings distributed over its entire surface and a fireproof material projecting towards the sealing side and material cast into the openings, wherein the fireproof material forms a plate with cylindrical or differently shaped projections protruding into the openings. The fireproof plate may be provided with a central projecting nose protruding between the casting rollers, the depth of which decreases from top to bottom. Onto the second part made from a high-temperature-resistant metal, a surrounding sheet may be fitted and forms a cassette with the latter which is inserted into a cooled holding frame, and in which the first wetted part is held and surrounded to the rear and along its entire contour with insulation. The second part may bear directly on the cooled holding frame. The two parts are allocated a rear metal plate which comprises the outlet openings of the first wetted part with the gas or lubricant source connecting channels or chambers. The rear plate may include additional connection channels connected to the gas or lubricant source to additional outlet openings arranged in the central common area of the second part, wherein the outlet openings distributed along the casting roller edges of this second part are connected to a separate gas or lubricant source. The first wetted part may consist of 25-50% metal and 75 to 50% fireproof material. The two parts may be provided on the sealing side with a suitable film. On the second part, on the sealing side, a heat and abrasion-proof film may be applied which has stamped holes for the outlet openings.

Owing the fact that an insulating layer separating the two parts from one another is inserted between the first and second part, heat loss is largely prevented or minimised at the lateral seals, so that even when using a protected metal plate in the wetted area no hardening occurs. The wetted part 12 can be kept very hot and can be preheated to a very high temperature (900-1,300° C.).

BRIEF DESCRIPTION OF THE DRAWINGS

The invention is explained in more detail in the following by way of the drawing. The Figures show.

DETAILED DESCRIPTION OF THE INVENTION

Figure 2:
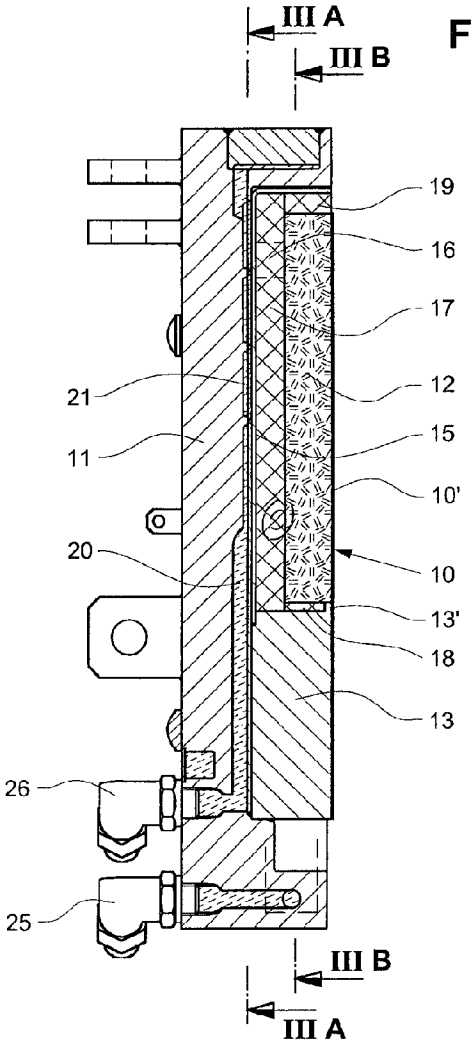
FIG. 2 a section along line II-II of FIG. 1.
Figure 4:
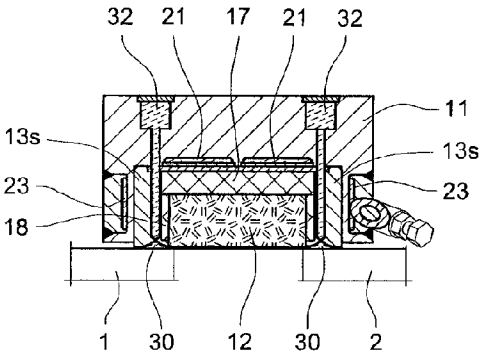
FIG. 4 a section along line IV-IV of FIG. 1.
Figure 5:
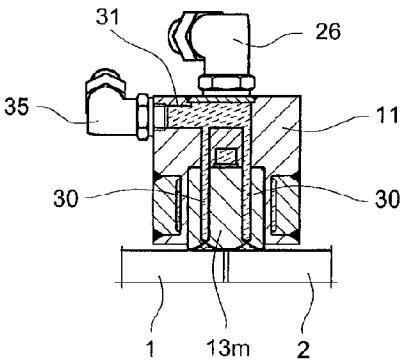
FIG. 5 a section along line V-V of FIG. 1.
Figure 3:
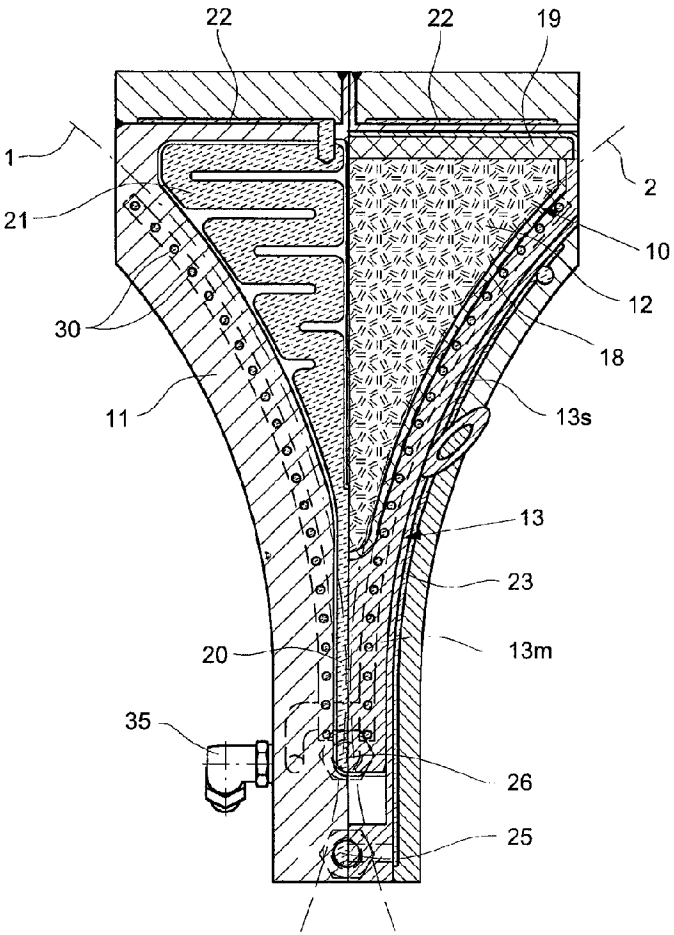
FIG. 3 in the left half a section along line IIIA-IIIA and in the right half a section along line IIIB-IIIB of FIG. 2.
Figure 7:
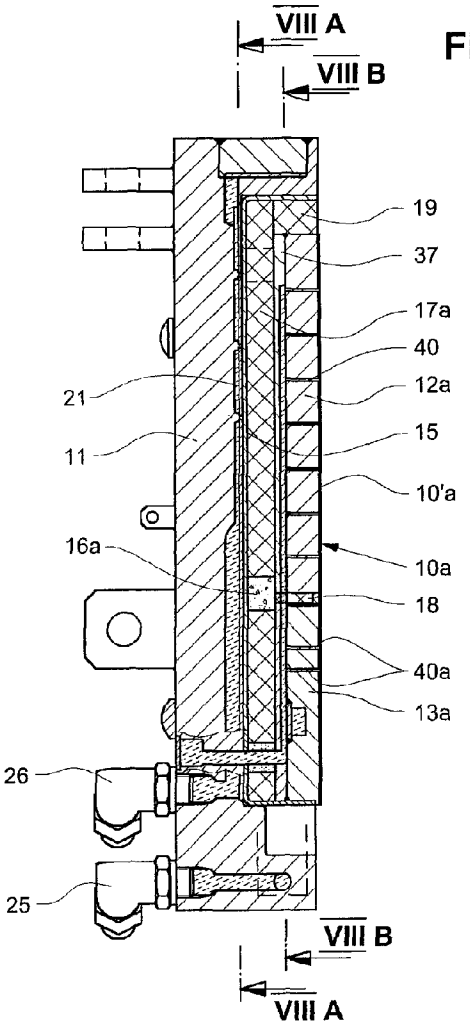
FIG. 7 a section along line VII-VII of FIG. 6.
Figure 6:
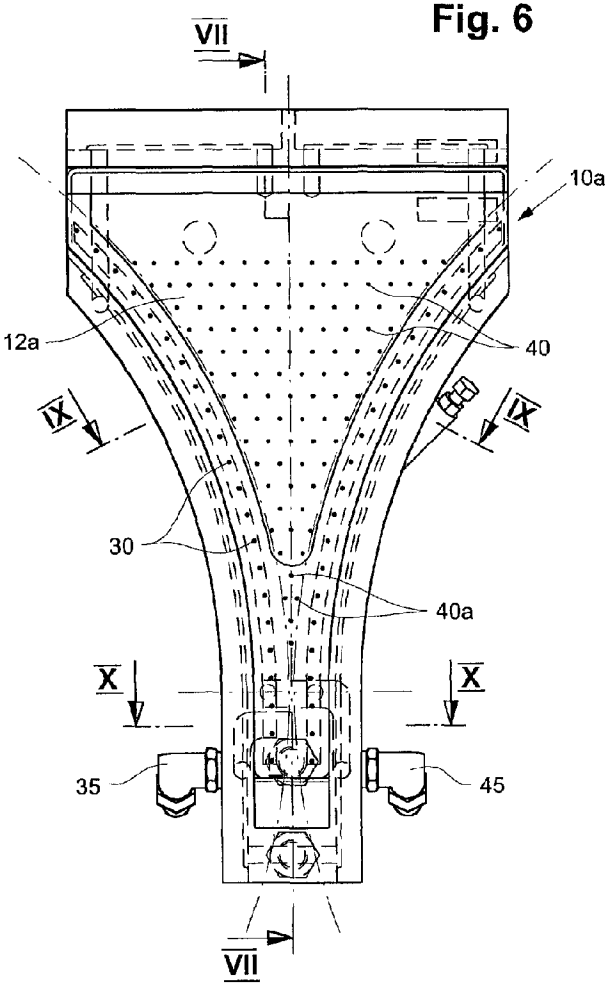
FIG. 6 a second embodiment of a lateral seal according to the invention in front view.
Figure 9:
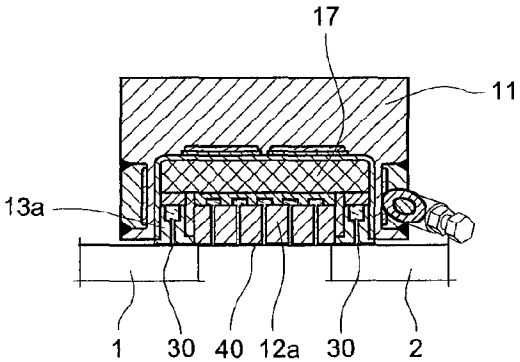
FIG. 9 a section along line IX-IX of FIG. 6.
Figure 10:
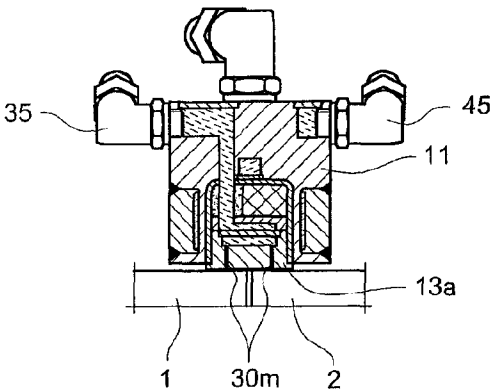
FIG. 10 a section along line X-X of FIG. 6.
Figure 8:
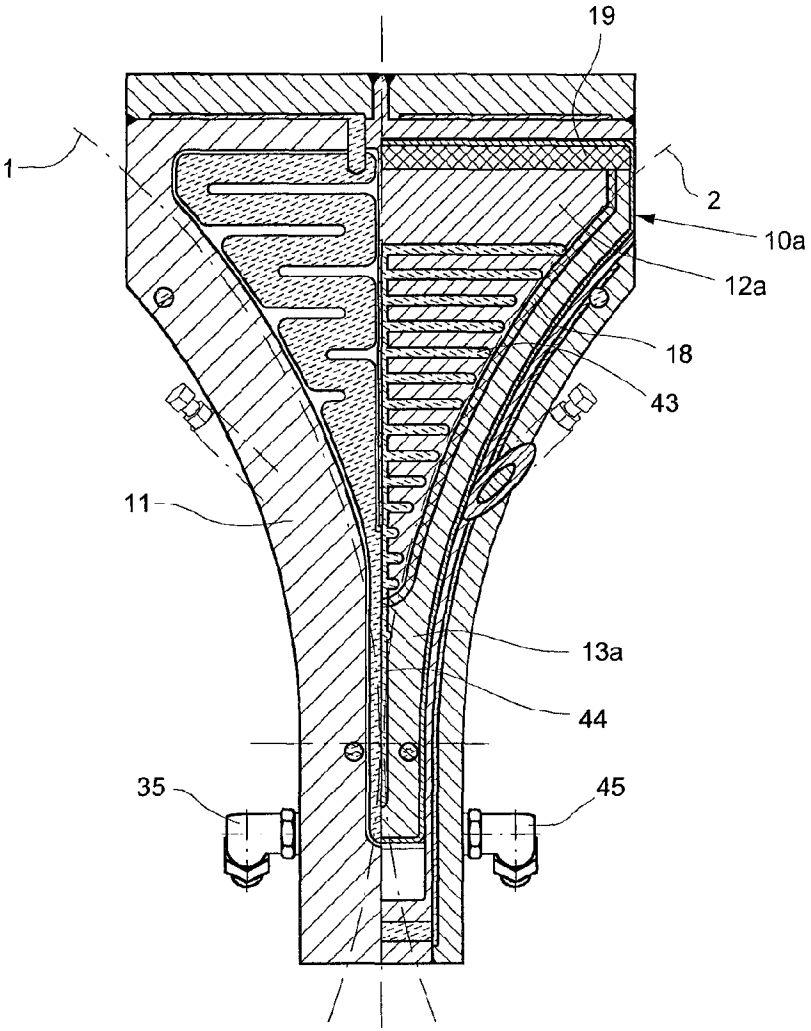
FIG. 8 in the left half a section along line VIIIA-VIIIA and in the right half a section along line VIIIB-VIIIB in FIG. 7.
Figure 12:
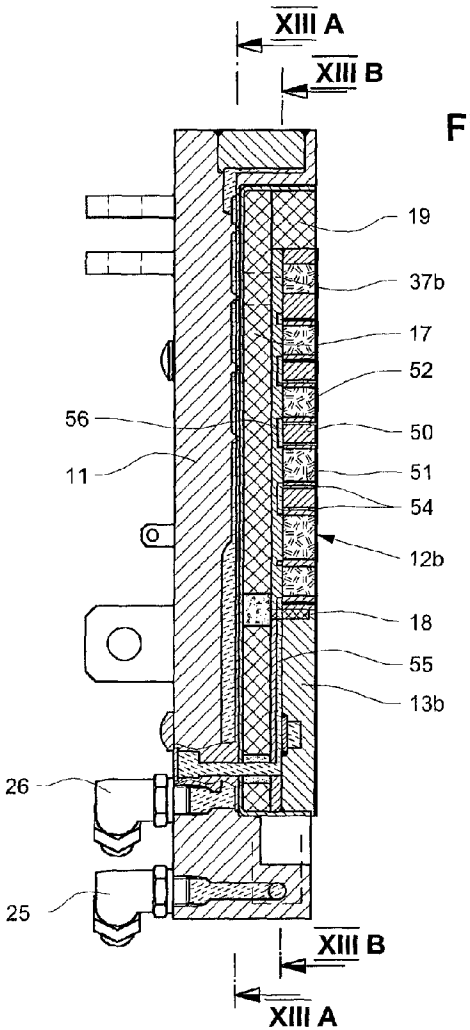
FIG. 12 a section along line XII-XII of FIG. 11.
Figure 11:
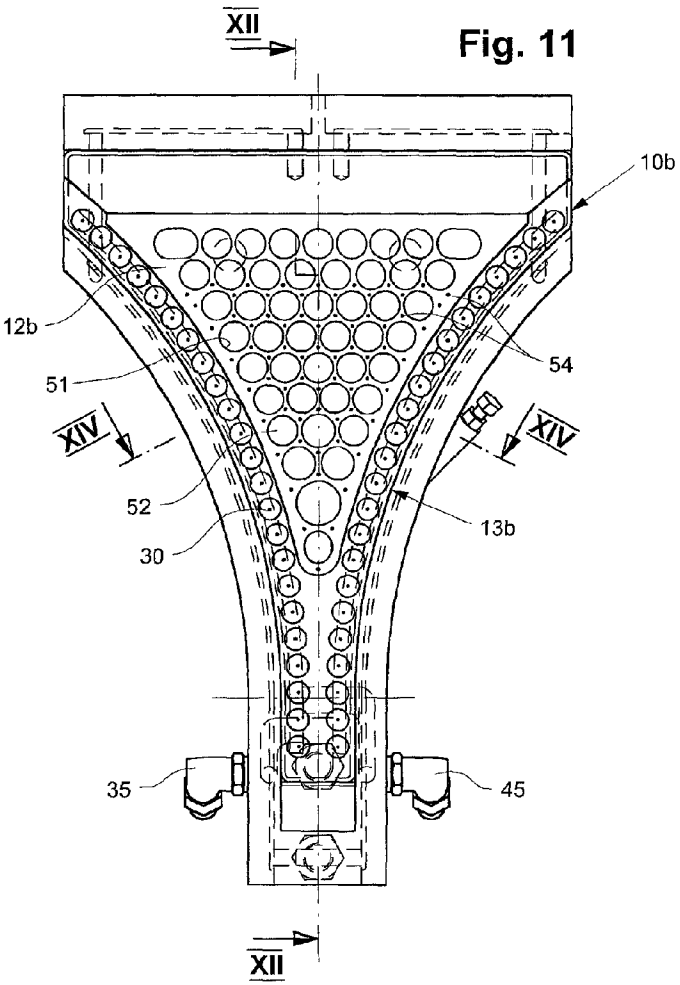
FIG. 11 a third embodiment of a lateral seal according to the invention in front view.
Figure 14:
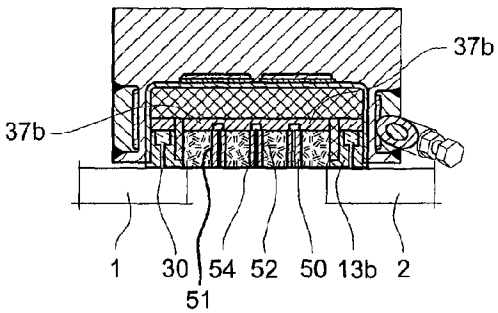
FIG. 14 a section along line XIV-XIV in FIG. 11.

FIGS. 1 to 5 show a first embodiment of a lateral seal 10 for a roller-strip casting machine which is provided for laterally sealing a casting gap formed between two casting rollers. Two lateral seals 10 (also called narrow side parts) arranged on both front sides of the casting rollers limit the length of the casting gap. The casting rollers are shown in FIGS. 3, 4 and 5 and denoted by 1, 2.

The lateral seal 10 is accommodated in a holding frame 11, which is in active connection with an adjusting device not shown in the drawing. The holding frame 11 can be adjusted together with the lateral seal 10 in longitudinal direction of the casting rollers 1, 2, by means of which the lateral seal 10 can be positioned with its sealing side 10' on front sides of the casting rollers 1, 2.

The lateral seal 10 comprises a so-called wetted first part 12, which in the embodiment variant according to FIGS. 1 to 5 is made from a fireproof material, and a second part 13 allocated to the front side of the casting rollers 1, 2, which is made of a preferably high-temperature-resistant metal. Both parts 12, 13 are preferably provided with a suitable coating. The second part 13 has a kind of "snout shape" with two legs 13*s* which extend along the casting roller front sides and join together at the bottom above a so-called kissing point to form a common middle area 13*m* (cf. in particular the right half of FIG. 3). The first part 12 projects from above between the two legs 13*s* of the second part 13 and is centred by the latter, and overlaps the casting roller front sides radially by 1 to 3 mm thus covering their edge area. The first part 12 is held in a surrounding sheet 15 (FIG. 2) attached onto the second part 13 and forming a kind of cassette with the latter, whereby it is positioned in the depression relative to the surrounding sheet 15 on the rear side facing away from the sealing side 10' by means of spacing pieces 16 and is separated from the surrounding sheet by an insulating plate 17 (FIG. 2).

According to the invention the first part 12 is provided not only to the rear but along its entire contour with insulation 18, 19 (FIGS. 2, 3, and 4), which also separates the two parts 12, 13 from one another and which for protection, to avoid compression, stands back slightly in the depression from the sealing side 10' of the parts 12, 13, and in addition a nose 13' centring the insulation and projecting from part 13 is provided.

The cassette-like lateral seal 10 is inserted from the front into the holding frame, so that the surrounding sheet 15 and the snout-shaped second part 13 lie at the rear on a base surface of the holding frame 11 provided with cooling channels 20, 21 for a cooling medium, preferably cooling water. The cooling channels 20, 21 are connected on the one hand to a cooling water inlet 26 (FIGS. 2, 3, and 5) and on the other hand via additional, upper and lateral holding frame-cooling channels 22, 23 to a cooling water outlet 25 (FIGS. 2 and 3). The snout-like second part 13 is thus cooled directly from the rear.

Figure 1:
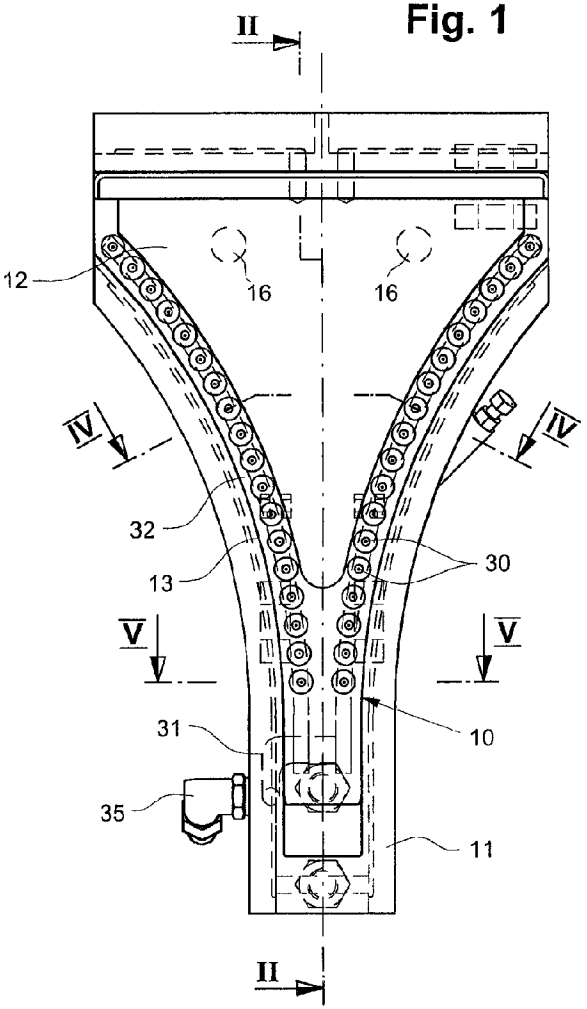
FIG. 1 a first embodiment of a lateral seal according to the invention in front view.

The snout-shaped second part 13 is provided according to the invention with a number of outlet openings 30 distributed preferably evenly along the edges of the casting rollers and directed opposite the front sides of the casting rollers 1, 2 which are connected via distribution channels 31, 32 to a gas or lubricant source 35 (FIGS. 1, 3 and 5). Through the outlet openings 30 inert gas, crude oil or other suitable materials such as grease or coatings containing graphite can be distributed over the sealing parts along the front sides or edges of the casting rollers and form a very thin bearing layer (gap 0.01-0.03 mm).

As already mentioned, the snout-shaped second part 13 (i.e. the front side of the sealing parts) is covered with a layer which can cushion the change in length of the casting rollers during casting. Instead of this a heat and abrasion-resistant film with suitably stamped holes for the outlet openings 30 can also be attached onto the second part 13.

It is known that lateral seals, particularly when they contain fireproof sealing plates or sealing plate parts as in the first part 12 according to FIGS. 1 to 5, need to be preheated prior to casting. The lateral seal 10 according to the invention, with insulation 18 inserted between the first and second part 12, 13 and separating the two parts 12, 13 from one another, has the advantage that, unlike in previous solutions, the majority of the heat is derived through the front sides of the casting rollers.

By means of the direct bearing of the snout-shaped second part 13 on the cooled holding frame 11 this area remains in terms of temperature substantially below the high temperature of 800-1,300° C. required for the first wetted part 12.

The outlet openings 30 in the snout-shaped second part 13 are produced as small bores in order to permit hydrodynamic bearing. They can also be in the form of slots extending in circumferential direction of the casting rollers.

In FIGS. 6 to 10, a second embodiment of a lateral seal 10*a* is shown. Identical parts of this lateral seal 10*a* are denoted by the same reference numbers as in FIGS. 1 to 5. The lateral seal 10*a* comprises a wetted first part 12*a* and a snout-shaped second part 13*a*, which bear at the rear on a metal plate 37, wherein the plate 37 is positioned in the depression by spacing pieces 16*a* opposite a surrounding sheet 15 and is separated from the latter by an insulation plate 17*a*. The lateral seal 10*a* is thus again designed in the form of a cassette which can be inserted from the front into the holding frame 11. (In fact, here too the snout-shaped second part 13*a* made from a high-temperature-resistant metal could also advantageously bear directly against the cooled holding frame 11.) The wetted first part 12*a* is made in this variant from a high-temperature-resistant metal and is provided with insulation 18, 19 along its entire contour, so that the two parts 12*a*, 13*a* are centered relative to one another but separate from one another.

The snout-shaped second part 13*a* also comprises further outlet openings 40*a* (FIGS. 6 and 10) in the central area 13*m* in addition to the outlet openings 30, 30*m* distributed along the casting roller edges. However, the metal first part 12*a*, which is preferably coated with a ceramic layer, is also provided with a number of outlet openings 40 distributed over its surface, which together with the additional outlet openings 40*a* in the middle area 13*m* of the second part 13*a* are connected to a separate gas or lubricant source 45 (inert gas, oil, coating, etc.), by means of a central, vertical connecting channel 44 and horizontal distribution channels 43 branching off from the latter, which are formed in the rear plate 37. In this way, a film can be formed on the sealing side 10*a'*.

The outlet openings 40 provided in the wetted first part 12*a* can vary in size over height in order to allow for ferrostatic differences in pressure.

In FIGS. 11 to 14 a further embodiment of a lateral seal 10*b* is shown, which comprises a snout-shaped part 13*b* made from a high-temperature-resistant metal, which is provided in turn with outlet openings 30 distributed along the roller edges and together with the wetted first part 12*b* bears on a rear metal plate 37*b*. The wetted part 12*b* is formed by a plate 50 made of a high-temperature-resistant metal which has a number of openings 51 distributed over the entire surface that are filled with a fireproof or fibre-like material 52. In this way it is taken into consideration that the expansion coefficients are selected to that no gaps can occur. This embodiment makes it possible to reduce the proportion of metal in the wetted first part 12*b* to 25-50%.

Around the openings 51 small bores are made in the metal plate 50 which form outlet openings 54 for a medium such as gas, oil, coatings etc. and are charged independently of the outlet openings 30 of the snout-shaped parts 13*b*, for which a separate source 45 and connection channels or chambers 55, 56 made in the rear plate 37*b* are provided. In this way the wetted first part 12*b* can be provided with an insulating protective film.

Figure 16:
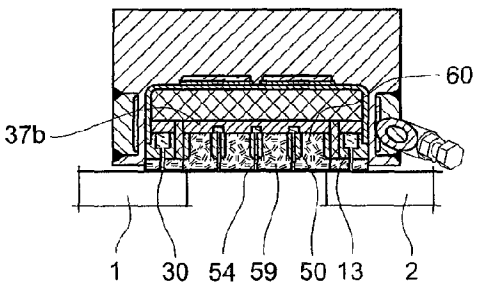
FIG. 16 the lateral seal according to FIG. 15 in horizontal cross section, corresponding to FIG. 14.
Figure 13:
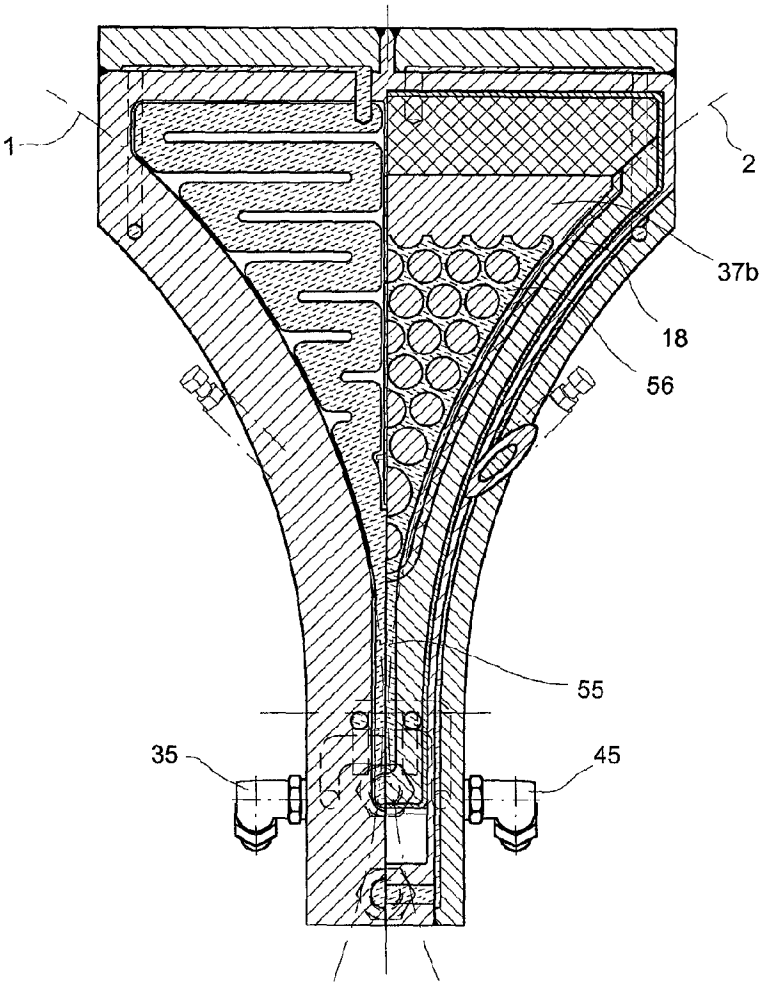
FIG. 13 in the left half a section along line XIIIA-XIIIA and in the right half a section along line XIIIB-XIIIB of FIG. 12.
Figure 15:
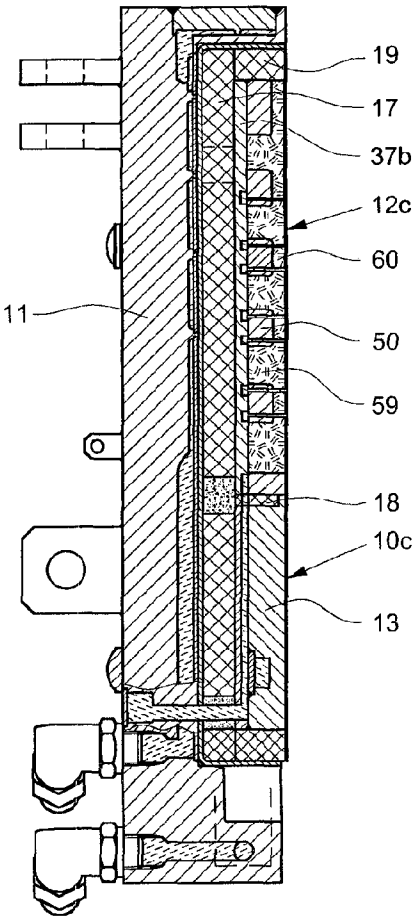
FIG. 15 a fourth embodiment of a lateral seal according to the invention in vertical cross section, corresponding to FIG. 12.

A lateral seal 10*c* shown in FIGS. 15 and 16 corresponds essentially to the aforementioned lateral seal 10*b*. The first part 12*c* comprises the metal plate 50 with larger openings 51, unlike the variant according to FIGS. 11 to 14, however the openings 51 alone are not filled but the metal plate 50 is filled with a fireproof material projecting over the seal side, so that a fireproof plate 59 is formed with cylindrical projections 60 protruding into the openings 51. In this way the metal plate 50 is further protected in terms of temperature and the removal of heat is reduced. The seal side is also coated in this case. The fireproof material is held together by the metal plate 50, i.e. the metal plate opposes the development of cracks in the fireproof material.

Figure 18:
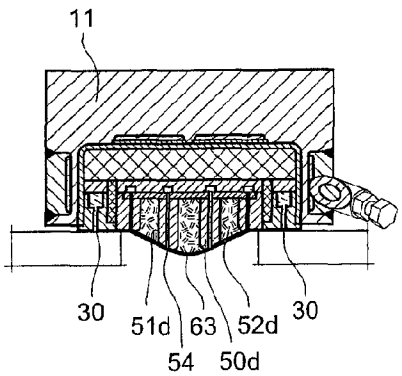
FIG. 18 the lateral seal according to FIG. 17 in horizontal cross section.
Figure 17:
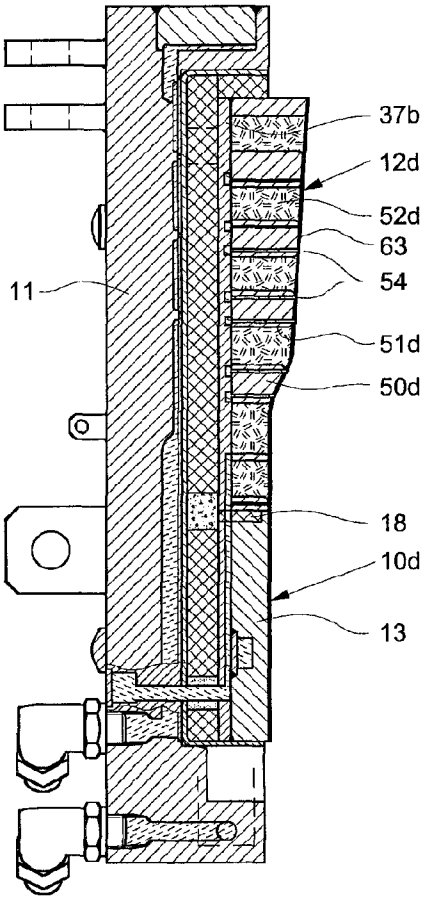
FIG. 17 a fifth embodiment of a lateral seal according to the invention in vertical cross section.

In FIGS. 17 and 18 a lateral seal 10*d* is shown which differs from the one shown in FIGS. 11 to 14 in that the first wetted part 12*d* (or its metal plate 50*d*, the openings 51*d* of which are filled with a fireproof material 52*d*) is provided with a central, projecting nose 63 protruding between the casting rollers 1, 2, wherein the depth of said nose 63 decreases from top to bottom. By means of this nose 63 the hot molten metal supplied from the casting pipe is forced into the edge area of the casting rollers 1, 2, in order to eliminate parasitic hardened areas.

Figure 20:
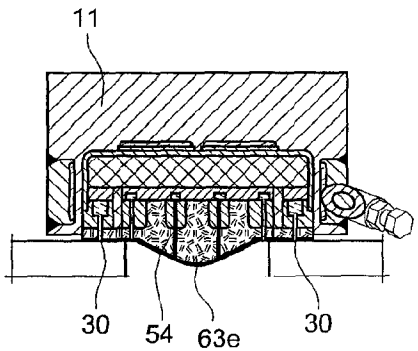
FIG. 20 the lateral seal according to FIG. 19 in horizontal cross section.
Figure 19:
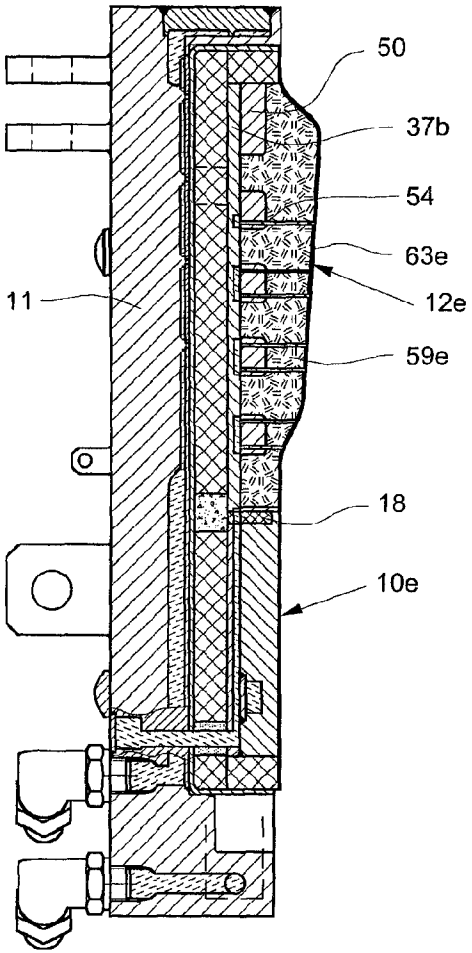
FIG. 19 a sixth embodiment of a lateral seal according to the invention in vertical cross section.

A lateral seal 10*e* shown in FIGS. 19 and 20 corresponds essentially to the design according to FIGS. 15 and 16, however the first wetted part 12*e* has a nose 63*e* protruding between the casting rollers 1, 2, which corresponds in shape to the one according to FIGS. 17 and 18 but is allocated to the fireproof plate 59*e*.

All of the embodiment variants described above are characterised by having the snout-shaped part 13 in which the wetted part 12 is held in a centred position by an interposed insulation 18. The wetted part 12 can be kept very hot and preheated to a very high temperature (900-1,300° C.).

Owing to the charging of gas or lubricant in the sealing area and due to the abrasion-resistant seating of the snout-shaped part wear is reduced considerably or largely prevented which considerably increases the durability of the lateral seals. The structure of the cassette of the lateral seals according to the invention permits various advantageous, exchangeable combinations of fireproof material and metal in the wetted area, with 25-50% metal and 75-50% fireproof material, whereby the fireproof material is held together advantageously in case of cracks. The lateral seals according to the invention are reworked or only need to be replaced partly. In this way it is possible to permit longer casting cycles and to recycle parts of the seal.

The cassette-like lateral seals could also be inserted from above instead of from the front in a suitably designed housing or into a holding frame open at the top. In fact the lateral seals according to the invention could also be installed directly into the holding frame without the surrounding sheet, i.e. the cassette structure is not absolutely necessary.

The invention claimed is:

1. Lateral seal of a casting gap formed between two casting rollers of a strip casting machine, which is positioned on a front of the casting rollers, and which comprises a first, wetted part and a second part allocated to front sides of the casting rollers, whereby the second part has two legs which extend along front faces of the casting rollers and join together at a bottom above a kissing point to form a common area, between which legs the first part protrudes from above, further comprising:

an insulating layer inserted between the first and the second part and which separates the two parts from one another.

2. Lateral seal according to claim 1, wherein the second part is provided with a number of outlet openings for inert gas or lubricants connected to a gas or lubricant source, aligned against the front sides of the casting rollers and distributed along edges of the casting rollers.

3. Lateral seal according to claim 2, wherein the first wetted part is made at least partly from a high-temperature-resistant metal and is provided with a number of outlet openings for inert gas or lubricants distributed over its entire surface, aligned against a sealing side and connected to an additional gas or lubricant source.

4. Lateral seal according to claim 3, wherein the first wetted part is designed as a metal plate comprising a number of openings distributed over its entire surface, wherein the openings are filled with a fireproof material and the outlet openings for inert gas or lubricants are provided between the openings filled with fireproof material.

5. Lateral seal according to claim 4, wherein the metal plate is provided with a centrally protruding nose projecting between the casting rollers, the depth of the centrally projecting nose decreasing from top to bottom.

6. Lateral seal according to claim 3, wherein the first wetted part is composed of a metal plate comprising a number of openings distributed over its entire surface and a fireproof material projecting towards the sealing side and material cast into the openings, wherein the fireproof material forms a plate with cylindrical or differently shaped projections protruding into the openings.

7. Lateral seal according to claim 6, wherein the fireproof plate is provided with a central projecting nose protruding between the casting rollers, the depth of the central projecting nose decreasing from top to bottom.

8. Lateral seal according to claim 1, wherein onto the second part made from a high-temperature-resistant metal, a surrounding sheet is fitted and forms a cassette with the second part which is inserted into a cooled holding frame, and in which the first wetted part is held and surrounded to the rear and along its entire contour with insulation.

9. Lateral seal according to claim 8, wherein the second part bears directly on the cooled holding frame.

10. Lateral seal according to claim 8, wherein the two parts are allocated a rear metal plate which comprises the outlet openings of the first wetted part with the gas or lubricant source connecting channels or chambers.

11. Lateral seal according to claim 10, wherein the rear plate comprises additional connection channels connected to the gas or lubricant source to additional outlet openings arranged in the central common area of the second part, wherein the outlet openings distributed along the casting roller edges of this second part are connected to a separate gas or lubricant source.

12. Lateral seal according to claim 3, wherein the first wetted part consists of 25-50% metal and 75 to 50% fireproof material.

13. Lateral seal according to claim 1, wherein the two parts are provided on a sealing side with a suitable film.

14. Lateral seal according to claim 2, wherein on the second part on a sealing side, a heat and abrasion-proof film is applied which has stamped holes for the outlet openings.

15. Lateral seal according to claim 2, wherein the second part is made from a high-temperature-resistant metal.

16. Lateral seal according to claim 2, wherein the lubricants are selected from a group consisting of oil, grease and graphite-containing coatings.

17. Lateral seal according to claim 3, wherein the lubricants are selected from a group consisting of oil, grease and graphite-containing coatings.

18. Lateral seal according to claim 4, wherein the lubricants are selected from a group consisting of oil, grease and graphite-containing coatings.

19. Lateral seal according to claim 1, wherein the first part is configured to overlap the front sides of the casting rollers such that the insulating layer between the first and second parts faces the front sides of the casting rollers.

20. Lateral seal according to claim 1, wherein the insulating layer is arranged along the entire contour of the first part such that the insulating layer is between a first one of the legs of the second part and the first part and also between a second one of the legs and the first part.

* * * * *